US012220072B2

(12) United States Patent
Ho et al.

(10) Patent No.: US 12,220,072 B2
(45) Date of Patent: Feb. 11, 2025

(54) HOOKLESS PAPER HANGER AND ATTACHABLE PLASTIC HOOK

(71) Applicant: Sourcing Solutions International Limited, Kowloon (HK)

(72) Inventors: Leung Ho, Kowloon (HK); Chi Man Leung, Kowloon (HK); Michael W. Dezelon, Paradise Valley, AZ (US)

(73) Assignee: Sourcing Solutions International Limited, Kowloon (HK)

( * ) Notice: Subject to any disclaimer, the term of this patent is extended or adjusted under 35 U.S.C. 154(b) by 0 days.

(21) Appl. No.: 17/894,081

(22) Filed: Aug. 23, 2022

(65) Prior Publication Data

US 2024/0065463 A1 Feb. 29, 2024

(51) Int. Cl.
*A47G 25/36* (2006.01)

(52) U.S. Cl.
CPC ..... *A47G 25/36* (2013.01)

(58) Field of Classification Search
CPC ..... A47G 25/36; A47G 25/14; A47G 25/38; A47G 25/28; A47G 25/16; A47G 25/20; A47G 25/26; A47G 25/30; A47G 25/32
See application file for complete search history.

(56) References Cited

U.S. PATENT DOCUMENTS

| | | | | | |
|---|---|---|---|---|---|
| 1,158,358 | A * | 10/1915 | Wordingham | B65D 85/182 | 223/71 |
| 2,347,414 | A | 1/1943 | Kearns | | |
| 2,383,819 | A * | 8/1945 | Ronning | A47G 25/38 | 223/87 |
| 3,162,341 | A * | 12/1964 | George | A47G 25/36 | 223/87 |
| 5,038,978 | A * | 8/1991 | Kolton | A47G 25/005 | 403/90 |
| 8,899,454 | B2 * | 12/2014 | Mainetti | A47G 25/32 | 223/94 |
| 11,134,804 | B2 * | 10/2021 | Mackenzie | A47G 25/38 | |
| D953,045 | S * | 5/2022 | Ho | D6/328 | |
| D953,756 | S * | 6/2022 | Ho | D6/328 | |
| 2019/0150637 | A1 * | 5/2019 | Ahearn | A47F 7/28 | |
| 2021/0307549 | A1 | 10/2021 | Rhyner et al. | | |

FOREIGN PATENT DOCUMENTS

| | | |
|---|---|---|
| BR | MU9100146 | 4/2012 |
| CN | 111317332 | 6/2020 |
| JP | 2002199979 | 7/2002 |

* cited by examiner

*Primary Examiner* — Ismael Izaguirre
(74) *Attorney, Agent, or Firm* — Schroeder Law PC

(57) ABSTRACT

A hookless paper hanger adapted for securement of a plastic hook thereto, and a method of assembling same. The hookless paper hanger allows display of a garment on a flat table, while the paper hanger/plastic hook combination allows display of the same item on a hanging rack.

20 Claims, 8 Drawing Sheets

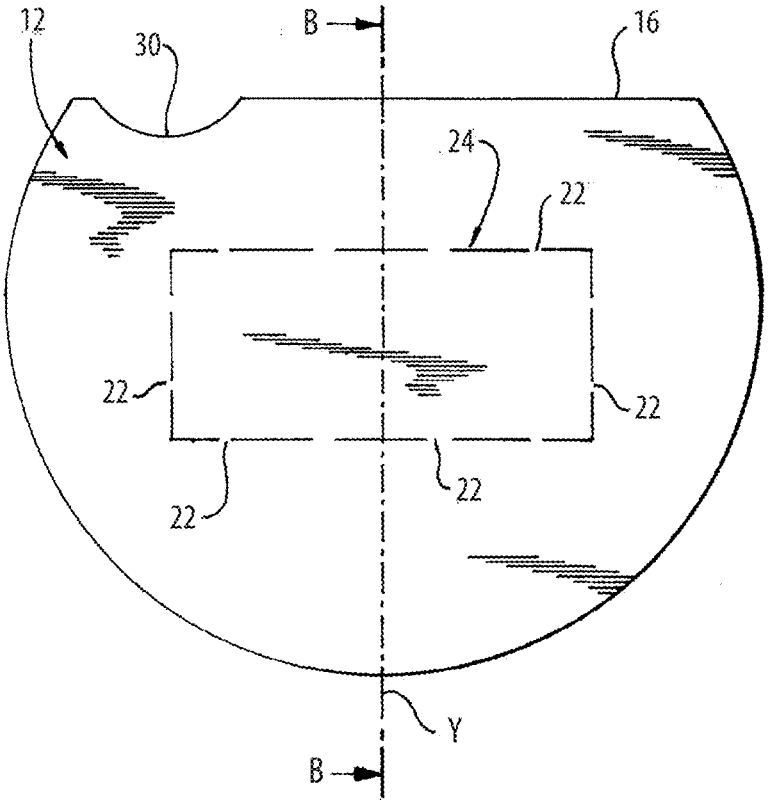
Fig. 2.1
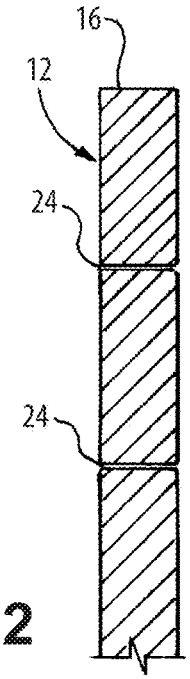
Fig. 2.2

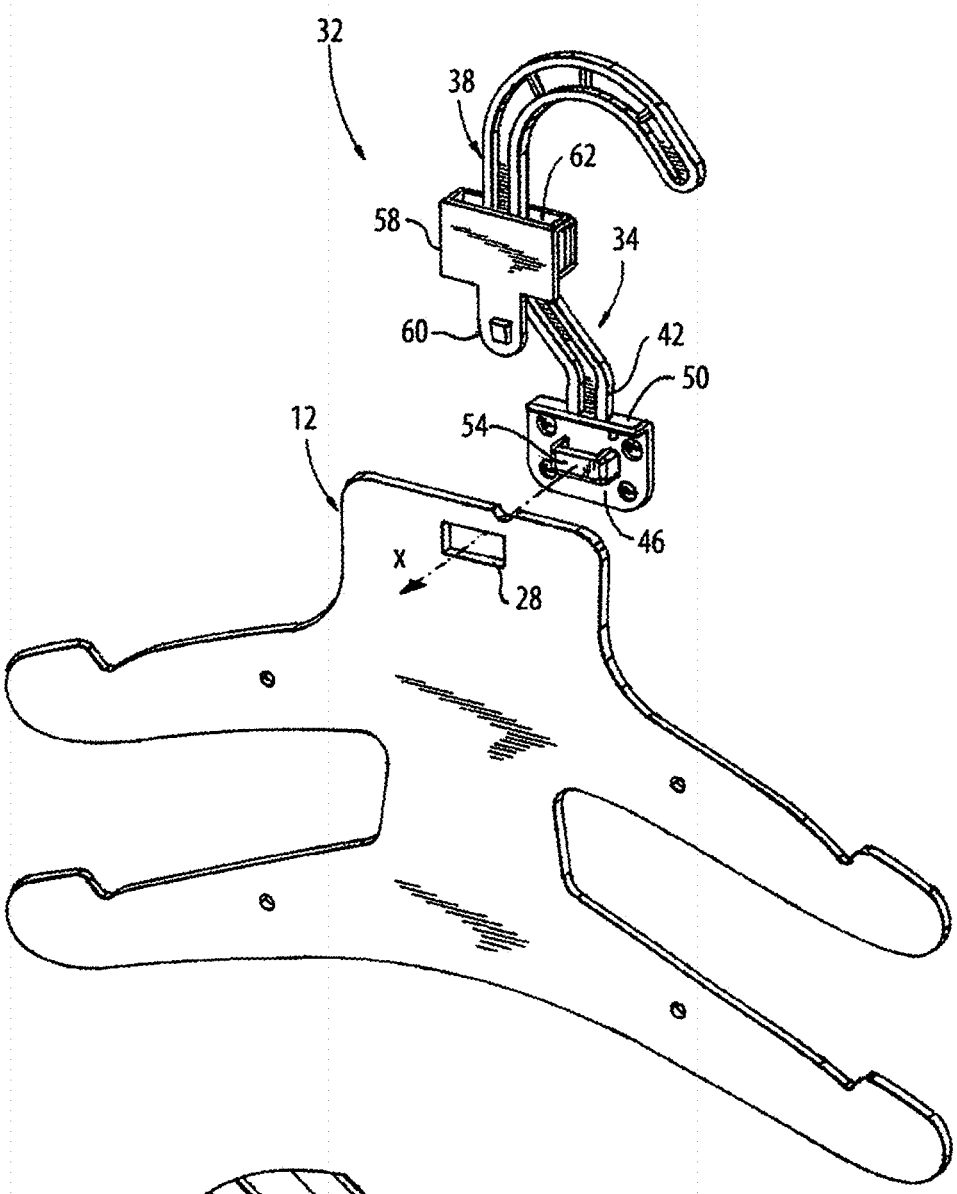
Fig. 6.1
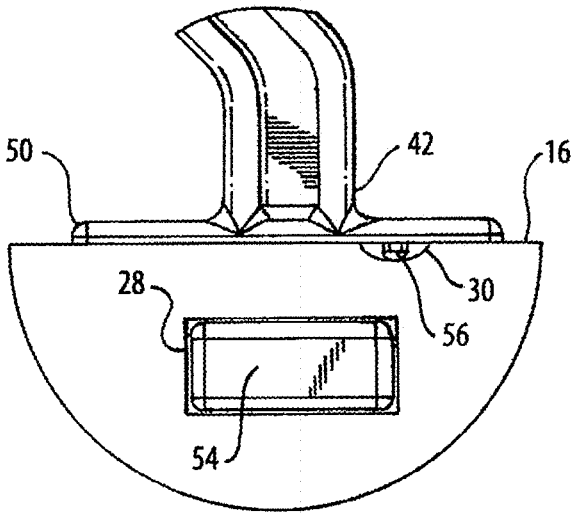
Fig. 6.2

HOOKLESS PAPER HANGER AND ATTACHABLE PLASTIC HOOK

BACKGROUND OF THE INVENTION

The present invention relates to hookless paper hangers and, more particularly, to a hookless paper hanger adapted and configured for securement of a plastic hook thereto.

Garments sold in retail outlets are often displayed on a hanger. Plastic garment hangers having plastic hooks are well-known in the art. These hangers are typically formed as an integral unit using an injection molding process. Plastic garment hangers having metal hooks are also well-known in the art. However, today there is more and more interest in finding ways to reduce the amount of plastic used in the garment industry.

One such solution is referred to as a paper hanger. In a first application of paper hangers as disclosed in commonly-owned co-pending U.S. application Ser. No. 17/380,179 filed Jul. 20, 2021 (the disclosure of which is hereby incorporated by reference), the body of the paper hanger is formed of cardboard or a similar paper stock material having sufficient strength to support the weight of the garment and a novel plastic hook, together with a sizer, is connected thereto to allow hanging of the paper hanger and garment supported thereon. In a second application of paper hangers, certain retail outlets (e.g., club stores) display their garments on tables. In this second application, the garment may be supplied to the retailer on a hookless paper hanger.

As will be understood by those in the industry, there are times (due to excess inventory or cancellation of orders) when a shipment of garments intended for sale within a club store (and supplied on hookless paper hangers) must be sold through another outlet. In the past, this would typically require the disassembly of each item, and the subsequent rehanging of the item on a hanger (whether plastic or paper) with a hook. Such a process is both labor intensive and expensive.

There is therefore a need in the art for a hookless paper hanger which is adapted for ready securement of a plastic hook thereto, thereby allowing cost effective conversion of the hookless hanger into a hooked hanger when a shipment of garments intended for display on flat tables needs to be displayed in a conventional hanging format.

SUMMARY OF THE INVENTION

The present invention, which addresses the needs of the prior art, provides a hookless paper hanger. The hookless paper hanger includes a paper hanger body. The paper hanger body includes a centrally-disposed portion defining a top edge. The centrally-disposed portion includes a first orienting member. The centrally-disposed portion further includes a plurality of perforations defining a geometric boundary. The paper hanger body further includes a first pair of opposing arms for supporting a first garment thereon. The arms extend from opposing sides of the centrally-disposed portion. In one preferred embodiment, the geometric boundary defines a rectangle. In another preferred embodiment, the first orienting member is a locating notch formed in said top edge. In still another preferred embodiment, the locating notch is U-shaped.

The present invention further provides a garment hanger. The garment hanger includes a paper hanger body. The paper hanger body includes a centrally-disposed trunk defining a top edge. The centrally-disposed trunk includes a first orienting member. The centrally-disposed trunk includes an attachment opening extending therethrough. The paper hanger body further includes a first pair of opposing arms for supporting a first garment thereon and a second pair of opposing arms for supporting a second garment thereon. The first and second pairs of arms extend from opposing sides of the centrally-disposed trunk. The garment further includes a plastic hook including a hook body and a lock member. The hook body includes a hanging arm having first and second ends. The first end of the hanging arm is sized to engage a rack. The hook body further includes an attachment base. The attachment base includes first and second opposing planar surfaces. The attachment base further includes a flange located along one edge thereof and extending in a direction X perpendicular to the first planar surface. The second end of the hanging arm is attached to the flange. The attachment base further includes a collar extending from the first planar surface in the direction X. The collar is sized to extend through the attachment opening in the paper hanger body. The attachment base further includes a second orienting member sized to engage the first orienting member when the hook body is properly oriented with respect to the paper hanger body. The lock member includes a sizer body portion and a tongue extending therefrom. The sizer body portion defines an interior opening sized and configured to allow passage of the hanging arm therethrough. The tongue is sized and configured to engage the collar thereby securing the plastic hook to the paper hanger body.

Finally, the present invention provides a method of assembling a plastic hook to a hookless paper hanger body. The method includes the step of providing a paper hanger body. The paper hanger body includes a centrally-disposed portion defining a top edge. The centrally-disposed portion includes a first orienting member. The centrally-disposed portion includes a plurality of perforations defining a geometric boundary. The paper hanger body further includes a first pair of opposing arms for supporting a first garment thereon. The arms extend from opposing sides of the centrally-disposed portion. The method includes the further step of providing a plastic hook including a hook body and a lock member. The hook body includes a hanging arm having first and second ends. The first end of the hanging arm is sized to engage a rack. The hook body further includes an attachment base. The attachment base includes first and second opposing planar surfaces. The attachment base further includes a flange located along one edge thereof and extending in a direction X perpendicular to the first planar surface. The second end of the hanging arm is attached to the flange. The attachment base further includes a collar extending from the first planar surface in the direction X. The collar is sized to substantially correspond to the geometric boundary in the paper hanger body. The attachment base further includes a second orienting member sized to engage the first orienting member when the hook body is properly oriented with respect to the paper hanger body. The lock member includes a sizer body portion and a tongue extending therefrom. The sizer body portion defines an interior opening sized and configured to allow passage of the hanging arm therethrough. The tongue is sized and configured to engage the collar. The method includes the further step of positioning the first planar surface of the attachment base of the hook body against the paper hanger body such that the collar substantially aligns with the geometric boundary. The method includes the further step of pushing the collar through the paper hanger body to define an attachment opening whereby the collar extends through the attachment opening and the flange engages an edge of the paper hanger body such that the second orienting member on the attachment base engages the first orienting member on the centrally-disposed portion thereby properly orientating the hook body with respect to the paper hanger body. The method includes the further step of installing the lock member by sliding the hanging arm through the interior opening of the sizer body portion and towards the second end of the hanging arm. Finally, the method includes the step of engaging the tongue with the collar to secure the plastic hook to the paper hanger body.

As a result, the present invention provides a hookless paper hanger which is adapted for ready securement of a plastic hook thereto, thereby allowing cost effective conversion of the hookless hanger into a hooked hanger when a shipment of garments intended for display on flat tables needs to be displayed in a conventional hanging format.

BRIEF DESCRIPTION OF THE DRAWINGS

FIG. 2.1 is an enlarged detail taken from FIG. 1;

FIG. 2.2 is an enlarged sectional view taken along lines B-B of FIG. 2.1;

FIG. 6.1 is a rear perspective view showing the plastic hook positioned for securement to the hookless paper hanger;

FIG. 6.2 is an enlarged detail showing the protrusion on the attachment base engaging the locating notch on the top edge of the hanger body;

DETAILED DESCRIPTION OF THE INVENTION

A hookless paper hanger 10 is shown in FIGS. 1-4. Hanger 10 includes a hanger body 12 preferably formed of cardboard or a similar paper stock material. Hanger body 12 includes a centrally-disposed trunk 14 defining a top edge 16. Hanger body 12 further includes a first pair of opposing arms 18*a*, 18*b* for supporting a first garment (not shown) thereon and a second pair of opposing arms 20*a*, 20*b* for supporting a second garment (not shown) thereon. Arms 18*a*, 18*b* extend from an upper portion of trunk 14, and arms 20*a*, 20*b* extend from a lower portion of trunk 14.

As will be recognized by those skilled in the art, hookless paper hanger 10 are used by certain retail outlets (e.g., club stores) to display their garments on a flat surface such as a table. The garments are supplied to the retailer already on the hookless paper hanger so that they ready for display on the table. There are times (due to excess inventory or cancellation of orders) when a shipment of garments intended for sale within a club store (and supplied on hookless paper hangers) must be sold through another outlet. In the past, this would typically require the disassembly of each item, and the subsequent rehanging of the item on a hanger (whether plastic or paper) with a hook. Such a process is both labor intensive and expensive.

Figure 1:
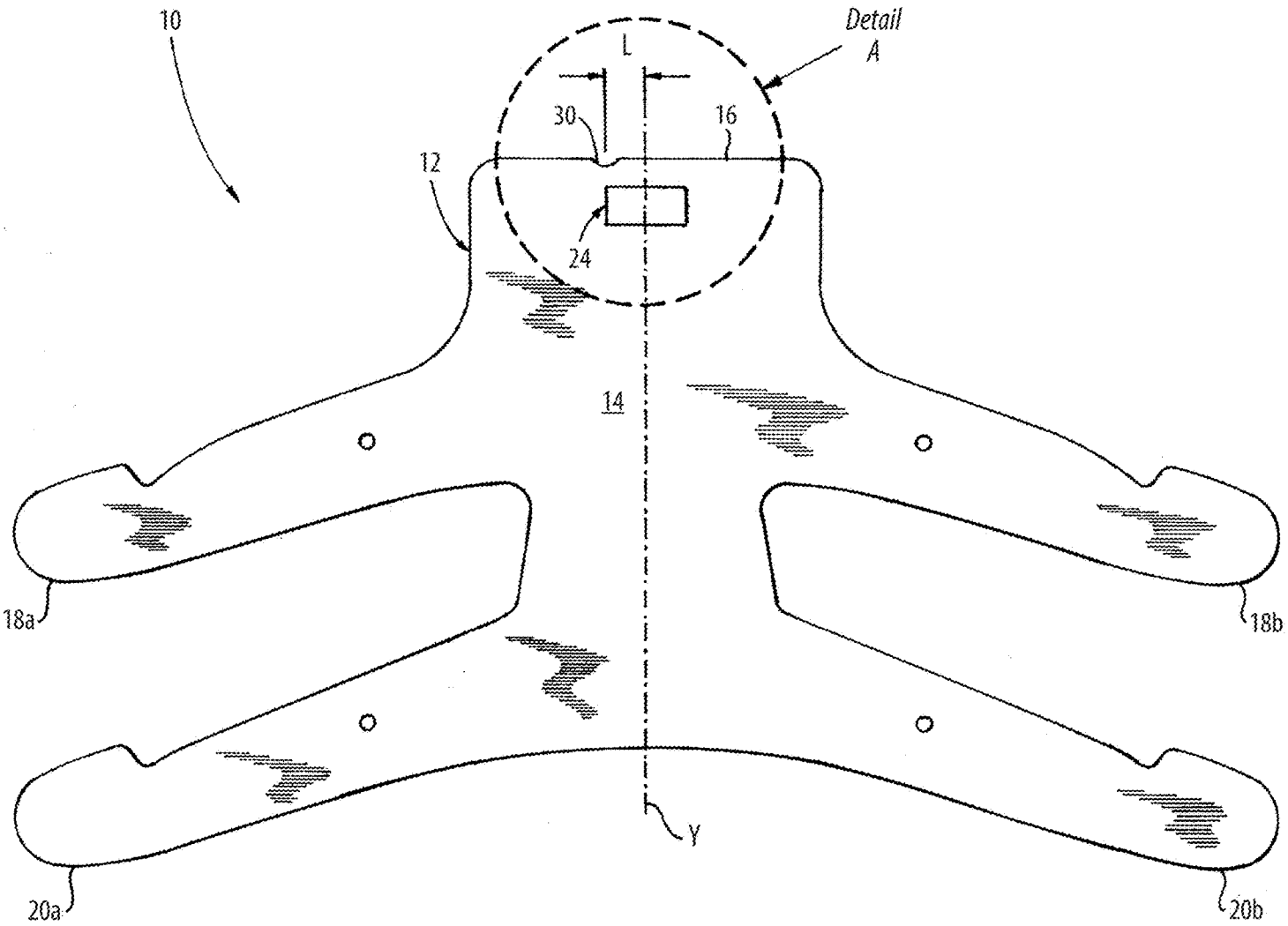
FIG. 1 is a front elevation view of a hookless paper hanger.
Figure 3:
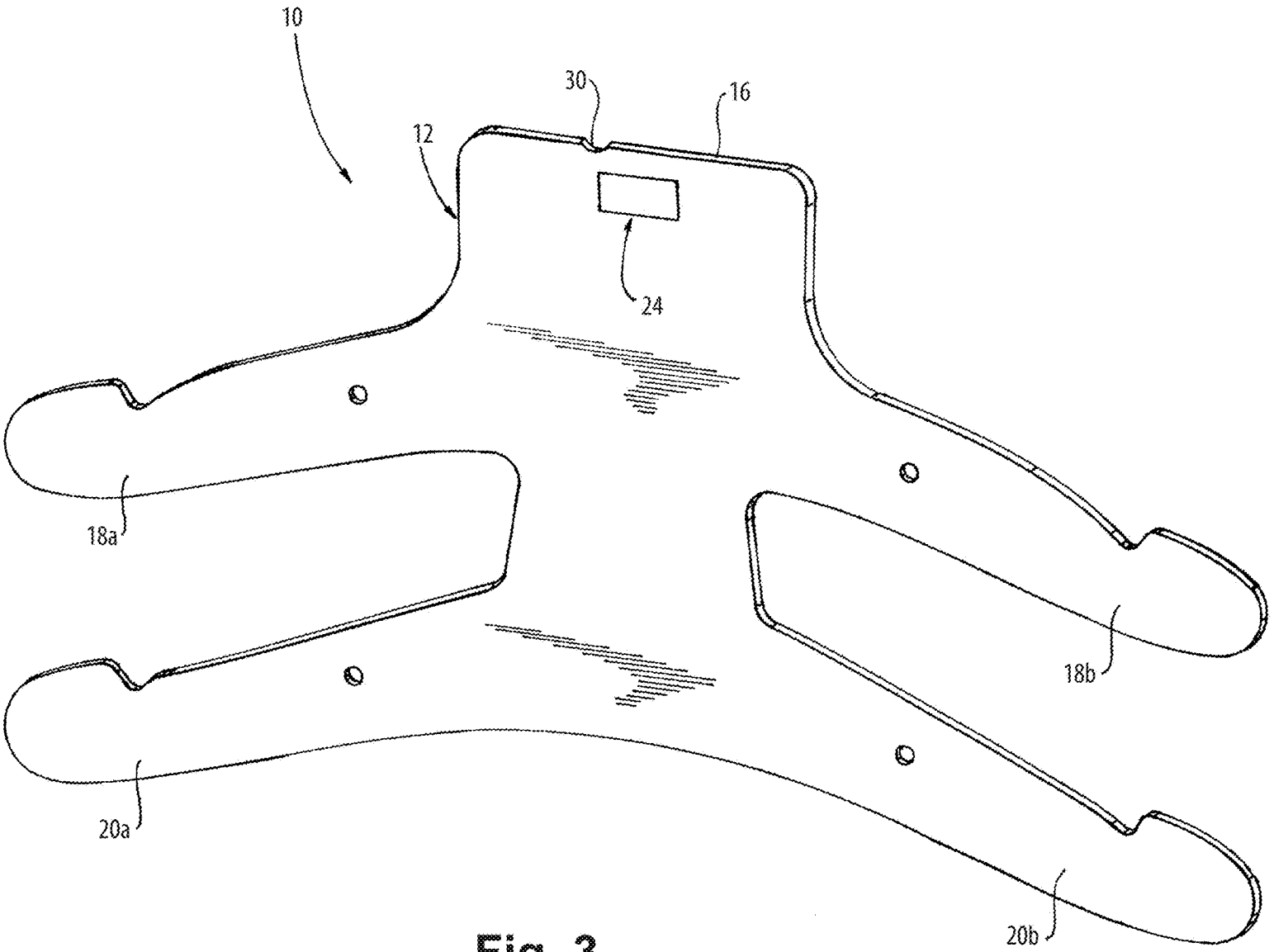
FIG. 3 is a perspective view of the hookless paper hanger of FIG. 1.
Figure 4:
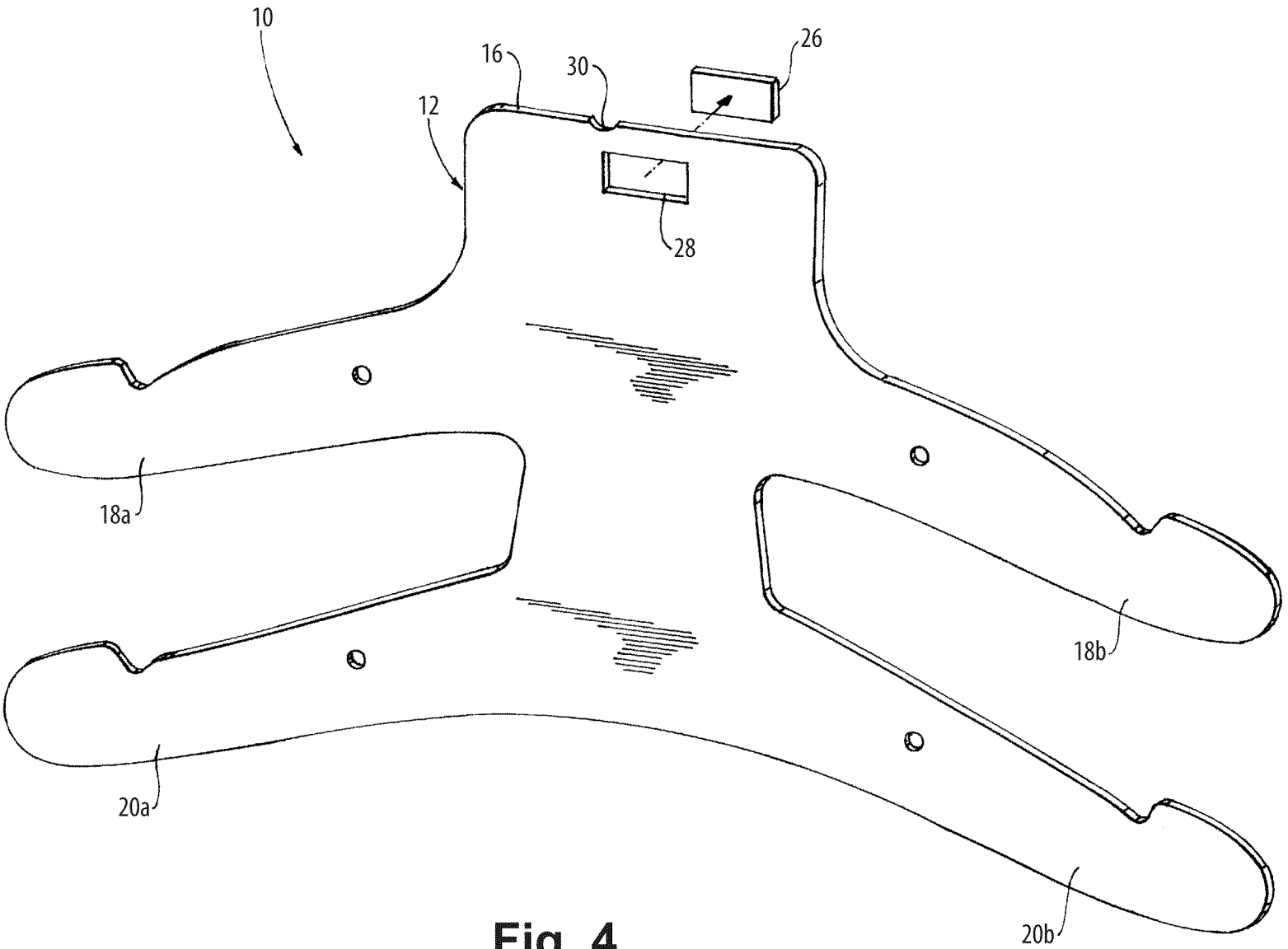
FIG. 4 is a perspective view similar to FIG. 3 showing the paper material defining the attachment opening removed from the hanger body.
Figure 5:
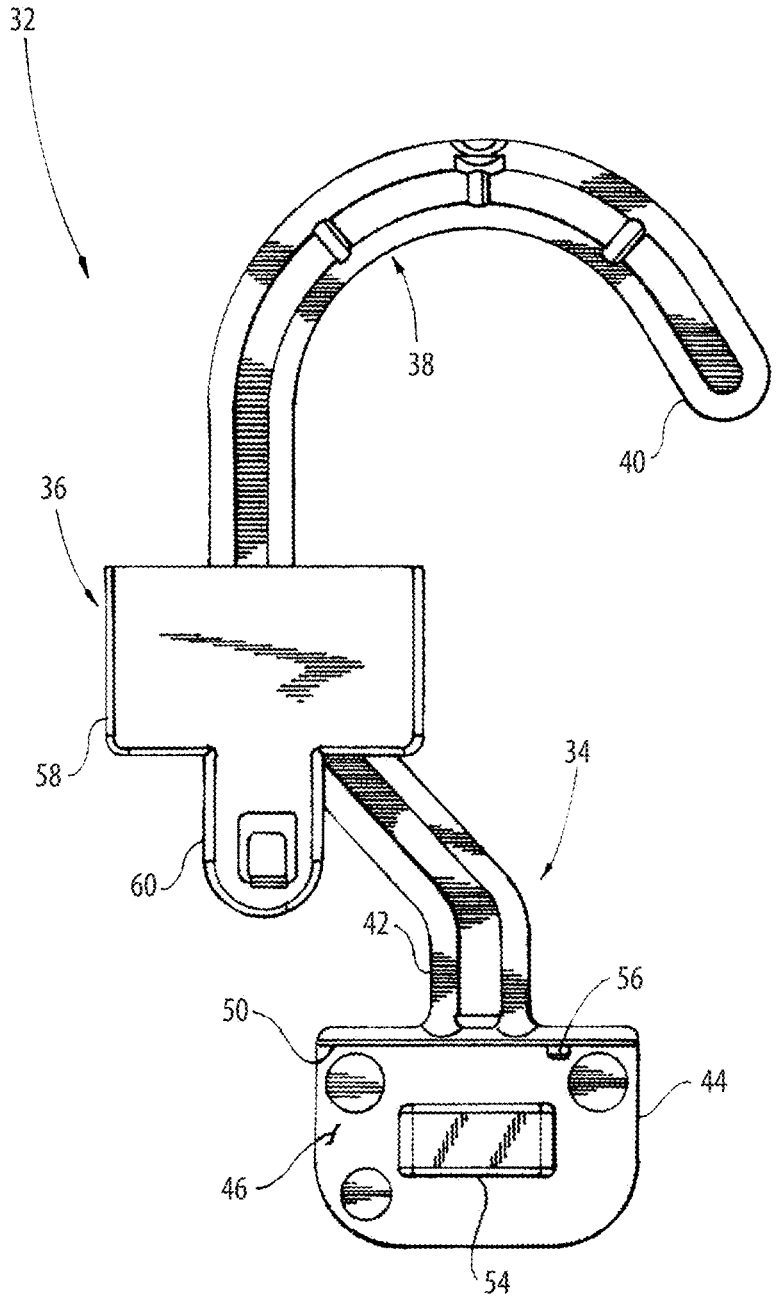
FIG. 5 is a rear elevation view of a plastic hook.
Figure 7:
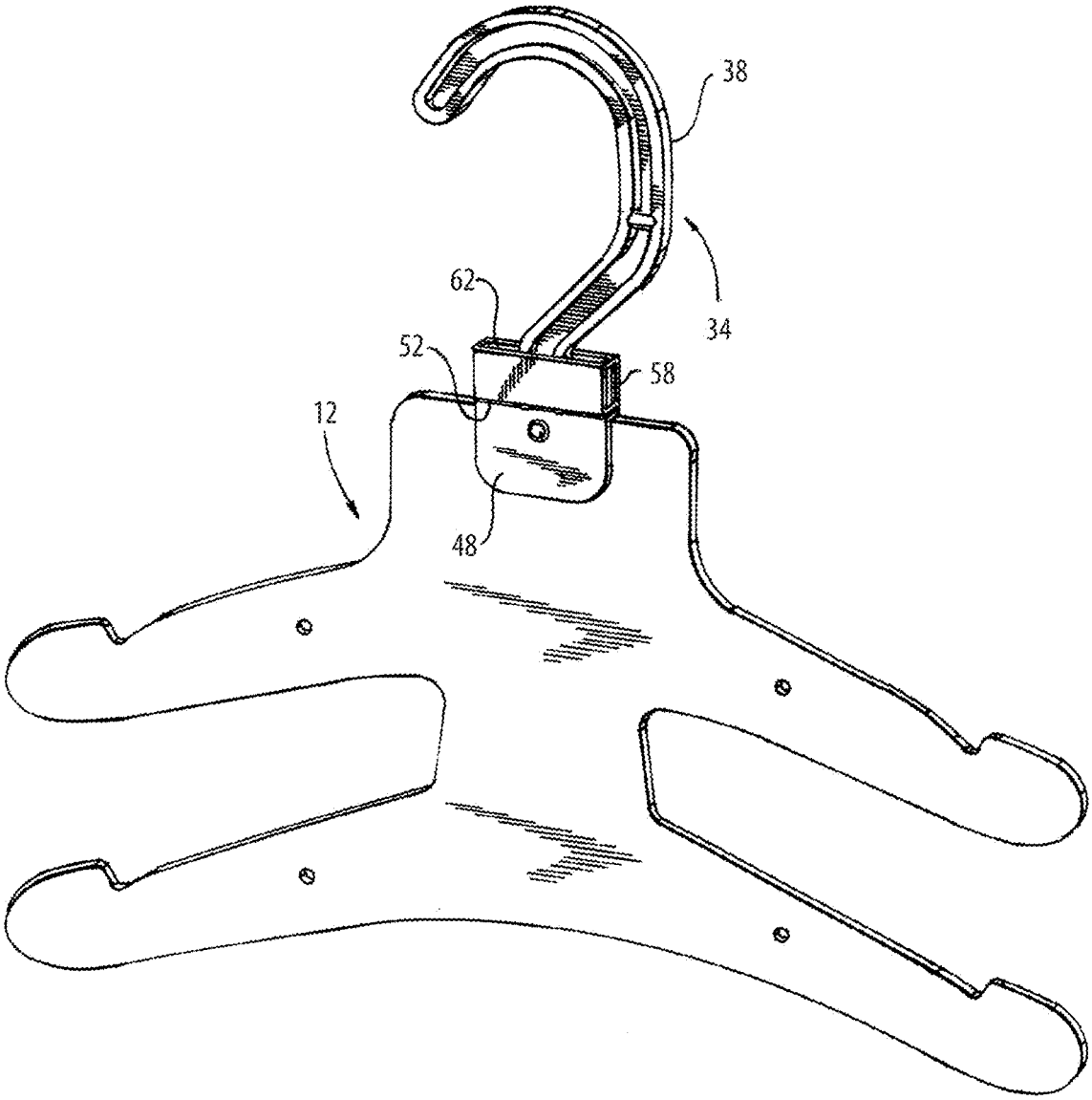
FIG. 7 is a front perspective view showing the plastic hook secured to the hookless paper hanger.
Figure 8:
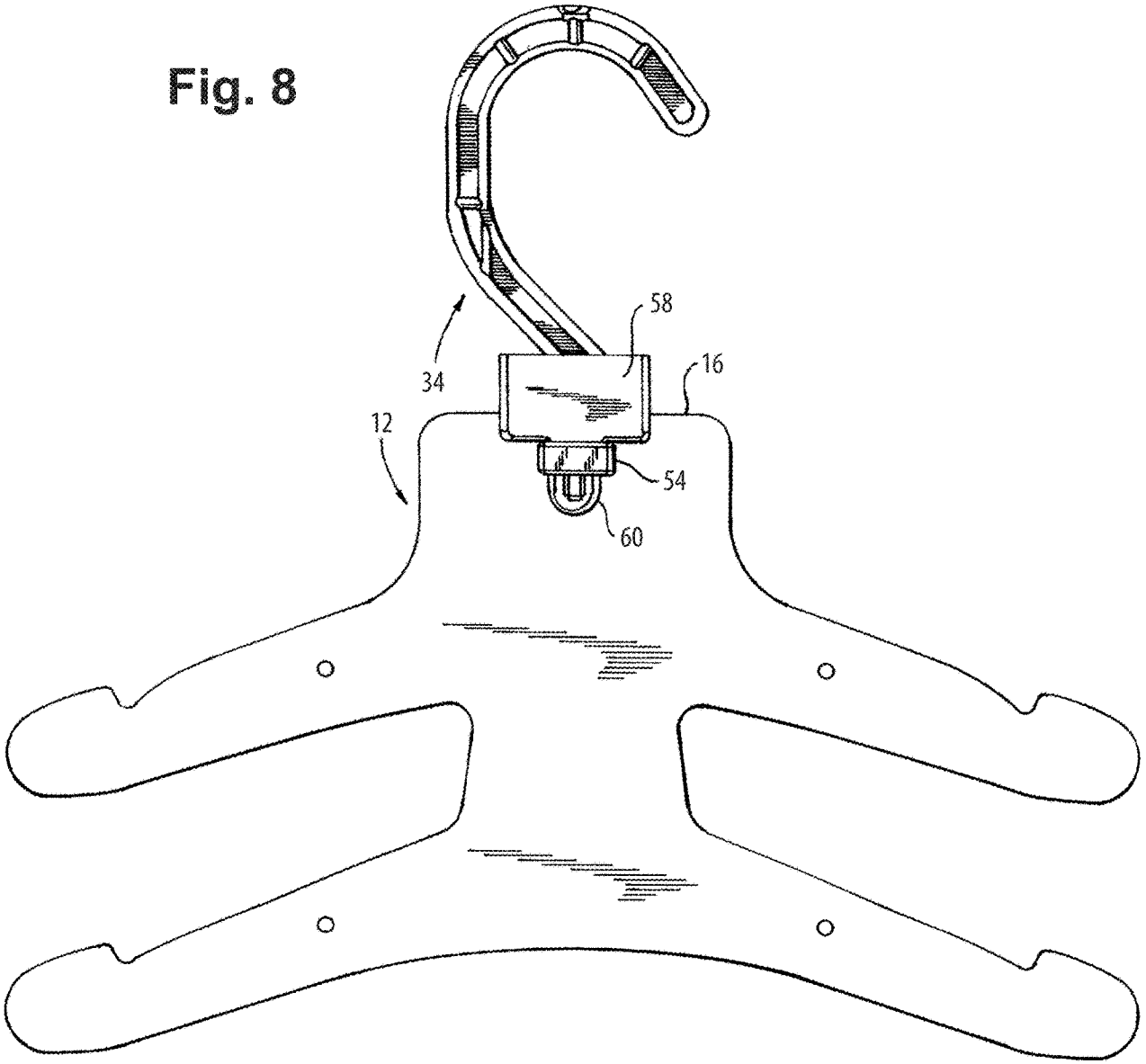
FIG. 8 is a rear elevaton view showing the plastic hook secured to the hookless paper hanger.

It has been discovered herein that a hookless paper hanger can be adapted for ready securement of a plastic hook thereto, thereby allowing cost effective conversion of the hookless hanger into a hooked hanger when a shipment of garments intended for display on flat tables needs to be displayed in a conventional hanging format. In this regard, hanger body 12 of the novel hookless paper hanger of the present invention includes a plurality of perforations 22 defining a geometric boundary, e.g., rectangle 24. It is contemplated herein that the geometric boundary could be any number of various shapes such as a circle, triangle, square, etc. In one preferred embodiment, rectangular 24 is located about an axis of symmetry Y extending through hanger body 12. The perforations allow the portion of material defined by the geometric boundary to be readily removed from hanger body 12 by applying pressure to the material within the boundary. A rectangular-shaped block 26 is shown in FIG. 4 exploded away from hanger body 12. The removal of block 26 provides a rectangular-shaped attachment opening 28 in hanger body 12. The perforations defining the geometric boundary are preferably formed during the stamping process.

The novel hookless paper hanger of the present invention further includes a first orienting member, e.g., locating notch 30, positioned on top edge 16. In one preferred embodiment, locating notch 30 is positioned a distance L from axis Y, thereby positioning notch 30 at an off-center location along top edge 16. In another preferred embodiment, locating notch 30 is formed in the shape of a "U". It is contemplated herein that the first orienting member could also be formed as an opening in the face of hanger body 12 or as a protrusion extending from a face of hanger body 12.

Referring now to FIGS. 5-8, the novel hookless paper hanger of the present invention is adapted for ready securement of a plastic hook 32 thereto. Plastic hook 32 in turn includes a hook body 34 and a lock member 36. Hook body 34 includes a hanging arm 38 having a first end 40 and a second end 42. First end 40 is preferably sized and configured to engage a rack whereby the garment can be hung for display. Hook body 34 further includes an attachment base 44 having a first planar surface 46 and an opposing second planar surface 48. Attachment base 44 further includes a flange 50 located along edge 52 and extending in a direction X perpendicular to first planar surface 46. The second end 42 of hanging arm 38 is connected to flange 50. In one preferred embodiment, hook body 34 is formed as a single, integral component. Attachment base 44 further includes a collar 54 extending outwardly from first planar surface 46 in direction X. In one preferred embodiment, collar 54 defines a substantially rectangular outline which is sized to correspond to rectangle 24.

Attachment base 44 further includes a second orienting member, e.g., protrusion 56, sized to engage locating notch 30 when hook body 34 is properly oriented with respect to hanger body 12. In particular, the industry practice is to orient the hook such that the open portion of the hook faces to the left when viewed from the front of the garment. The positioning of locating notch 30 at an off-center location along top edge 16 ensures that hook body 34 can be installed only in the correct orientation.

Lock member 36 includes a sizer body portion 58 and a tongue 60 extending therefrom. Sizer body portion 58 is preferably formed of four connected walls defining a rectangular cross section and an interior opening 62 sized and configured to allow passage of hanging arm 38 therethrough such that sizer body portion 58 substantially surrounds second end 42 of hanging arm 38 and tongue 60 engages collar 54. However, it is contemplated herein that sizer body portion 58 may also be formed from three connected walls (e.g., by eliminating one of the shorter end walls) or from a substantially continuous curved wall whereby the sizer body portion substantially/completely encloses interior opening 62. In one preferred embodiment, tongue 60 includes an opening and attachment base 44 includes a tab located and biased to engage the opening when the tongue is inserted within collar 54.

When it is necessary/desired to convert hookless hanger 10 into a hooked hanger, the retailer positions a plastic hook 32 next to hookless hanger 10 such that collar 54 engages rectangle 24. The hook is pressed against hanger body 12 until rectangular block 26 is expelled from hanger body 12 thereby defining an attachment opening 28. In one particularly preferred embodiment, collar 54 is sized to maintain frictional engagement with attachment opening 28 when installed therethrough. Thereafter, plastic hook 32 is assembled to hanger body 12. In this regard, hook body 34 is oriented with respect to the hanger body such that the collar on the hook body extends through the attachment opening in the hanger body and protrusion 56 on attachment base 44 engages locating notch 30, thereby ensuring the proper orientation of plastic hook 32. The lock member is then installed by inserting the hanging arm through the interior opening of the sizer body portion of the lock member, and sliding the lock member towards the second end of the hanging arm. The lock member is oriented such that the tongue is positioned to engage the collar. Finally, the tongue is inserted into the collar thereby securing the plastic hook to the paper hanger body.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. A hookless paper hanger, comprising:

a paper hanger body, said paper hanger body including a centrally-disposed portion defining a top edge, said centrally-disposed portion including a first orienting member, said centrally-disposed portion further including a plurality of perforations defining a geometric boundary, said geometric boundary surrounding and defining a removable portion of material of said paper hanger body, said removable portion of paper material being continuous with said paper hanger body, said paper hanger body further including a first pair of opposing arms for supporting a first garment thereon, said arms extending from opposing sides of said centrally-disposed portion.

2. The hookless paper hanger according to claim 1, wherein said geometric boundary defines a rectangle.

3. The hookless paper hanger according to claim 2, wherein said first orienting member is a locating notch formed in said top edge.

4. The hookless paper hanger according to claim 3, wherein said locating notch is U-shaped.

5. The hookless paper hanger according to claim 3, wherein said locating notch is spaced a distance X from a center line extending through said paper hanger body whereby said location notch is off-center with respect to said paper hanger body.

6. The hookless paper hanger according to claim 3, wherein said centrally-disposed portion defines a trunk, said first pair of opposing arms extending from an upper area of said trunk; and further comprising a second pair of opposing arms for supporting a second garment thereon, said second pair of opposing arms extending from a lower area of said trunk.

7. A garment hanger, comprising:

a paper hanger body, said paper hanger body including a centrally-disposed trunk defining a top edge, said centrally-disposed trunk including a first orienting member, said centrally-disposed trunk including an attachment opening extending therethrough, said paper hanger body further including a first pair of opposing arms for supporting a first garment thereon and a second pair of opposing arms for supporting a second garment thereon, said first and second pairs of arms extending from opposing sides of said centrally-disposed trunk; and a plastic hook including a hook body and a lock member, said hook body including a hanging arm having first and second ends, said first end of said hanging arm being sized to engage a rack, said hook body further including an attachment base, said attachment base including first and second opposing planar surfaces, said attachment base further including a flange located along one edge thereof and extending in a direction X perpendicular to said first planar surface, said second end of said hanging arm being attached to said flange, said attachment base further including a collar extending from said first planar surface in said direction X, said collar sized to extend through said attachment opening in said paper hanger body, said attachment base further including a second orienting member sized to engage said first orienting member when said hook body is properly oriented with respect to said paper hanger body, said lock member including a sizer body portion and a tongue extending therefrom, said sizer body portion defining an interior opening sized and configured to allow passage of said hanging arm therethrough, said tongue being sized and configured to engage said collar thereby securing said plastic hook to said paper hanger body.

8. The garment hanger according to claim 7, wherein said first orienting member is a locating notch formed in said top edge.

9. The garment hanger according to claim 8, wherein said locating notch is U-shaped.

10. The garment hanger according to claim 9, wherein said locating notch is spaced a distance X from a center line extending through said trunk whereby said locating notch is off-center with respect to said trunk.

11. A method of assembling a plastic hook to a hookless paper hanger body, comprising:

providing a paper hanger body, said paper hanger body including a centrally-disposed portion defining a top edge, said centrally-disposed portion including a first orienting member, said centrally-disposed portion including a plurality of perforations defining a geometric boundary, said paper hanger body further including a first pair of opposing arms for supporting a first garment thereon, said arms extending from opposing sides of said centrally-disposed portion;

providing a plastic hook including a hook body and a lock member;

said hook body including a hanging arm having first and second ends, said first end of said hanging arm being sized to engage a rack, said hook body further including an attachment base, said attachment base including first and second opposing planar surfaces, said attachment base further including a flange located along one edge thereof and extending in a direction X perpendicular to said first planar surface, said second end of said hanging arm being attached to said flange, said attachment base further including a collar extending from said first planar surface in said direction X, said collar sized to substantially correspond to said geometric boundary in said paper hanger body, said attachment base further including a second orienting member sized to engage said first orienting member when said hook body is properly oriented with respect to said paper hanger body; said lock member including a sizer body portion and a tongue extending therefrom, said sizer body portion defining an interior opening sized and configured to allow passage of said hanging arm therethrough, said tongue being sized and configured to engage said collar;

positioning said first planar surface of said attachment base of said hook body against said paper hanger body such that said collar substantially aligns with said geometric boundary;

pushing said collar through said paper hanger body to define an attachment opening whereby said collar extends through said attachment opening and said flange engages an edge of said paper hanger body such that said second orienting member on said attachment base engages said first orienting member on said centrally-disposed portion thereby properly orientating said hook body with respect to the paper hanger body;

installing said lock member by sliding said hanging arm through said interior opening of said sizer body portion and towards said second end of said hanging arm; and engaging said tongue with said collar to secure said plastic hook to said paper hanger body.

12. The method according to claim 11, wherein said first orienting member is a locating notch formed in said top edge.

13. The method according to claim 12, wherein said locating notch is U-shaped.

14. The method according to claim 12, wherein said second orienting member is a protrusion located on said attachment base.

15. The method according to claim 14, wherein said tongue includes a tab for engaging said collar.

16. The method according to claim 15, wherein said tongue includes an opening, and further comprising a tab positioned on said first planar surface of said attachment base for engaging said opening in said tongue.

17. The method according to claim 16, wherein said attachment opening in said paper hanger body is rectangular, and wherein said collar defines a rectangular boundary which substantially corresponds in size and shape to said rectangular attachment opening, said collar being sized to maintain frictional engagement with said attachment opening when said collar extends therethrough.

18. The method according to claim 17, wherein at least an edge of said sizer body portion contacts said flange when said lock member is in said first position.

19. The method according to claim 18, wherein said tongue engages said collar when said lock member is in said first position.

20. The method according to claim 19, wherein said sizer body portion is sized and configured to allow sliding movement of said lock member along said flange from said first position to a second position wherein said tongue engages said collar.

* * * * *